US008684155B2

(12) United States Patent
Mishra et al.

(10) Patent No.: US 8,684,155 B2
(45) Date of Patent: Apr. 1, 2014

(54) DOCUMENT HANDLER FOR TABLE GAMES

(75) Inventors: Kunal Mishra, Tokyo (JP); Makoto Hasegawa, Tokyo (JP); Keiichi Togano, Tokyo (JP)

(73) Assignee: Japan Cash Machine Co., Ltd., Osaka (JP)

( * ) Notice: Subject to any disclaimer, the term of this patent is extended or adjusted under 35 U.S.C. 154(b) by 0 days.

(21) Appl. No.: 13/533,342

(22) Filed: Jun. 26, 2012

(65) Prior Publication Data

US 2012/0325616 A1 Dec. 27, 2012

(30) Foreign Application Priority Data

Jun. 27, 2011 (JP) ..... 2011-141838

(51) Int. Cl.
*G07F 7/04* (2006.01)

(52) U.S. Cl.
USPC ..... 194/206; 194/350

(58) Field of Classification Search
USPC ..... 194/206, 207, 350; 463/47; 209/534
See application file for complete search history.

(56) References Cited

U.S. PATENT DOCUMENTS

| | | | | |
|---|---|---|---|---|
| 6,745,887 | B2 | 6/2004 | Heidel et al. | |
| 6,968,787 | B2 | 11/2005 | Heidel et al. | |
| 7,255,215 | B2 | 8/2007 | Iannello et al. | |
| 2004/0134839 | A1 * | 7/2004 | Kobayashi et al. | 209/534 |
| 2008/0041932 | A1 * | 2/2008 | Christophersen et al. | 235/379 |
| 2010/0138308 | A1 * | 6/2010 | Fujita et al. | 705/16 |
| 2011/0005892 | A1 * | 1/2011 | Ohishi | 194/206 |

FOREIGN PATENT DOCUMENTS

| | | | |
|---|---|---|---|
| JP | 2005275876 | A | 10/2005 |
| WO | 2009013836 | A1 | 1/2009 |
| WO | 2009128167 | A1 | 10/2009 |
| WO | 2010095213 | A1 | 8/2010 |

OTHER PUBLICATIONS

International Search Report for PCT/JP2012/004147, dated Sep. 11, 2012.

* cited by examiner

*Primary Examiner* — Mark Beauchaine
(74) *Attorney, Agent, or Firm* — Bachman & LaPointe, P.C.

(57) ABSTRACT

A document handler is provided that comprises: a casing 1 disposed adjacent to a gaming table 9, a deposit chamber 11 formed on an external side of casing 1 for receiving bills, an escrow chamber 14 formed on the external side of casing 1 for, visibly to players and removably from outside of casing 1 and temporarily, receiving genuine bills sent from deposit chamber 11, an escrow carrier 15 for transporting documents from deposit chamber 11 to escrow chamber 14, and a drive device 2 for driving escrow carrier 15.

11 Claims, 8 Drawing Sheets

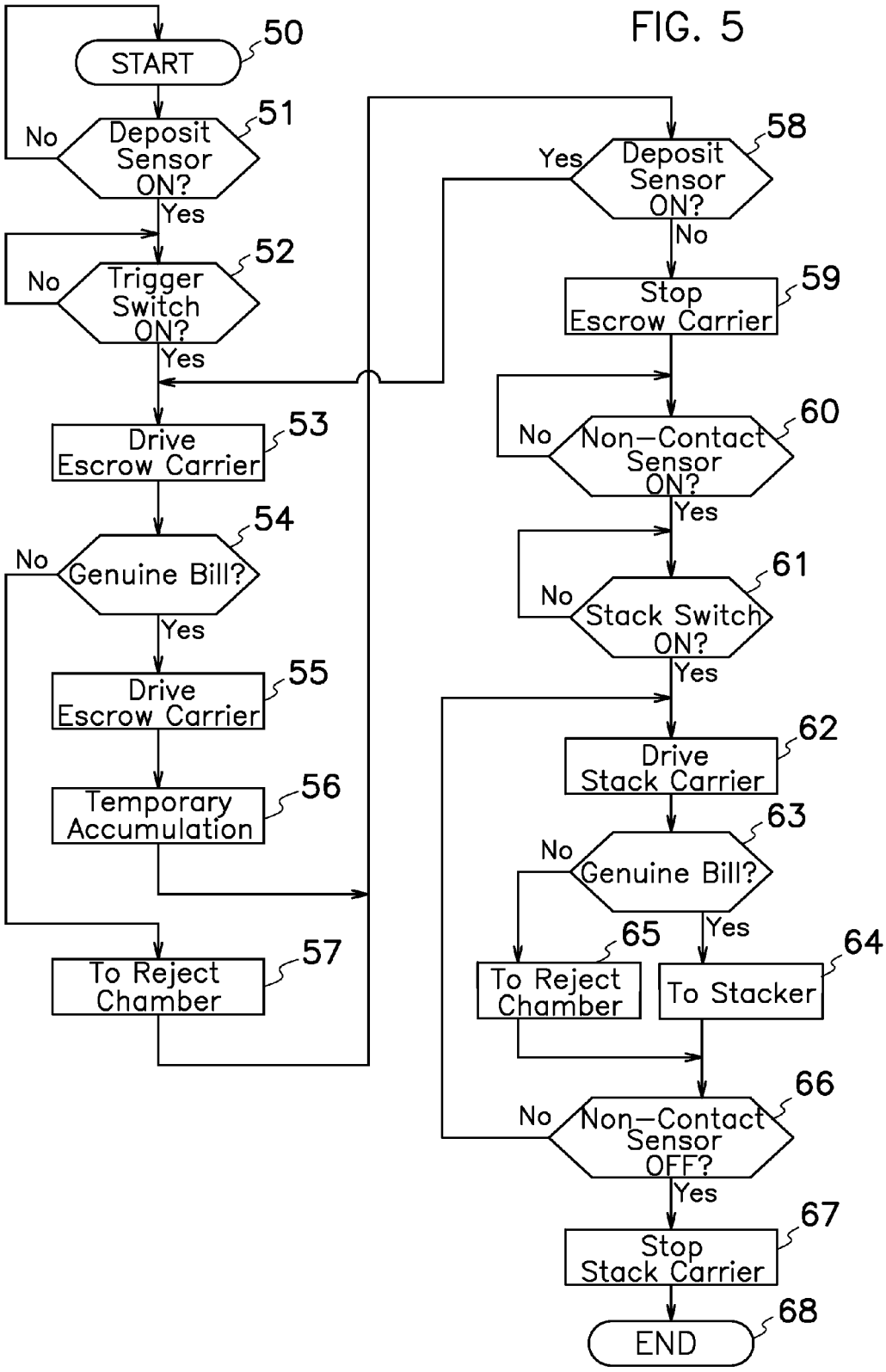
FIG. 5
START
50
Deposit Sensor ON?
51
No
Yes
Trigger Switch ON?
52
No
Yes
Drive Escrow Carrier
53
Genuine Bill?
54
No
Yes
Drive Escrow Carrier
55
Temporary Accumulation
56
To Reject Chamber
57
Deposit Sensor ON?
58
Yes
No
Stop Escrow Carrier
59
Non-Contact Sensor ON?
60
No
Yes
Stack Switch ON?
61
No
Yes
Drive Stack Carrier
62
Genuine Bill?
63
No
Yes
To Reject Chamber
65
To Stacker
64
Non-Contact Sensor OFF?
66
No
Yes
Stop Stack Carrier
67
END
68

DOCUMENT HANDLER FOR TABLE GAMES

TECHNICAL FIELD

This invention relates to a document handler for table games for validating documents, for visibly to players and removably from outside and temporarily accumulating the documents in an escrow chamber and for finally stowing the documents in a stacker.

BACKGROUND OF THE INVENTION

For example, U.S. Pat. No. 6,745,887 to Raymond Heidel, et al. indicates a bill acceptor for use on a gaming table that comprises a validator for identifying characteristics of a note passed through the validator by a transportation system, and a cash box mounted below a surface of the gaming table for receiving valid notes at the end of the path through the validator and for storing valid notes. A bill guard attached to gaming table is positioned near bill acceptor to minimize the possibility that a player could reach onto gaming table and remove notes as they were being fed into or rejected from bill acceptor. Bill guard can be made of a translucent material such as high impact plastic to allow the dealer and players to watch bills through bill guard as they are inserted into or rejected from validator. However, once bills are inserted into inside of bill acceptor, players cannot observe, confirm, exchange or withdraw the bills inserted into the validator.

On the other hand, Japanese Patent Disclosure No. 2005-275876 to T. Ohori, et al. demonstrates an automated teller machine having an inner escrow for temporarily retaining bills received within the machine. However, no one can directly observe the bills retained in the escrow, and to reconfirm the bills in the escrow, a conveyor has to be driven in the adverse direction to thereby return the bills from the escrow to a bill reject slot of the machine. When the bills already returned to bill reject slot are found to be no problem, same operations must be repeated while inserting bills into a bill inlet. Also, in view of the security commitment, no escrow can be provided in a position within one's grasp of this machine.

An object of the present invention is to provide a document handler for table games capable of, visibly to players and removably from outside and temporarily, accumulating documents in an escrow chamber after evaluating authenticity of the documents before stowage of the documents in a stacker. Another object of the present invention is to provide a document handler for table games capable of visually confirming any problem or question raised on collected documents for security of the documents' authenticity, transparency and fairness of games. Still another object of the present invention is to provide a document handler for table games that may convey documents from a deposit chamber to an escrow chamber through a validator to confirm the documents' authenticity and further may convey the documents from the escrow chamber to a stacker.

SUMMARY OF THE INVENTION

The document handler for table games according to the present invention, comprises: a casing (1), a deposit chamber (11) formed on an external side of the casing (1) for receiving documents, an escrow chamber (14) formed on the external side of the casing (1) for, visibly to players and removably from outside of casing (1) and temporarily, receiving genuine documents sent from deposit chamber (11), an escrow carrier (15) for transporting documents from deposit chamber (11) to escrow chamber (14), and a drive device (2) for driving escrow carrier (15).

Escrow carrier (15) transports and accumulates only genuine documents from deposit chamber (11) to escrow chamber (14) while all players can watch documents being accumulated in escrow chamber (14). In other words, all eyes may be turned to documents accumulated and stored in escrow chamber (14) and this may accurately identify nonparticipation of unjustifiable acts on documents in escrow chamber (14). If any question or problem arises such as there is a need to confirm money amount of documents in escrow chamber (14), documents in question may be easily taken out from escrow chamber (14) for the confirmation. If no question arises on documents, the documents may be returned in escrow chamber (14) and a stack carrier (17) may be driven to transport documents from escrow chamber (14) to a stacker (16). As just described, the document handler may accumulate and temporarily retain only authentic documents in escrow chamber (14) so that documents may be taken out from escrow chamber (14) to visually confirm any problem or question raised on documents for security of documents' authenticity, transparency and fairness in documents' handling to thereby smoothly conduct games.

BRIEF DESCRIPTION OF THE DRAWINGS

The above-mentioned and other objects and advantages of the present invention will be apparent from the following description in connection with preferred embodiments shown in the accompanying drawings wherein:

FIG. 5 is a flow chart showing an operational sequence of the bill handling apparatus to transport bills from a deposit chamber to a stacker through an escrow chamber;

BEST MODE FOR CARRYING OUT THE INVENTION

Embodiments of the document handler according to the present invention will be described hereinafter in connection with FIGS. 1 to 10 of the drawings. The term "documents" herein broadly means all or any of valuable papers including bills, currencies, plastic money, coupon tickets, tokens, tenders, securities and scrip while the embodiments of the invention exemplifies bills dealt for table games.

Figure 1:
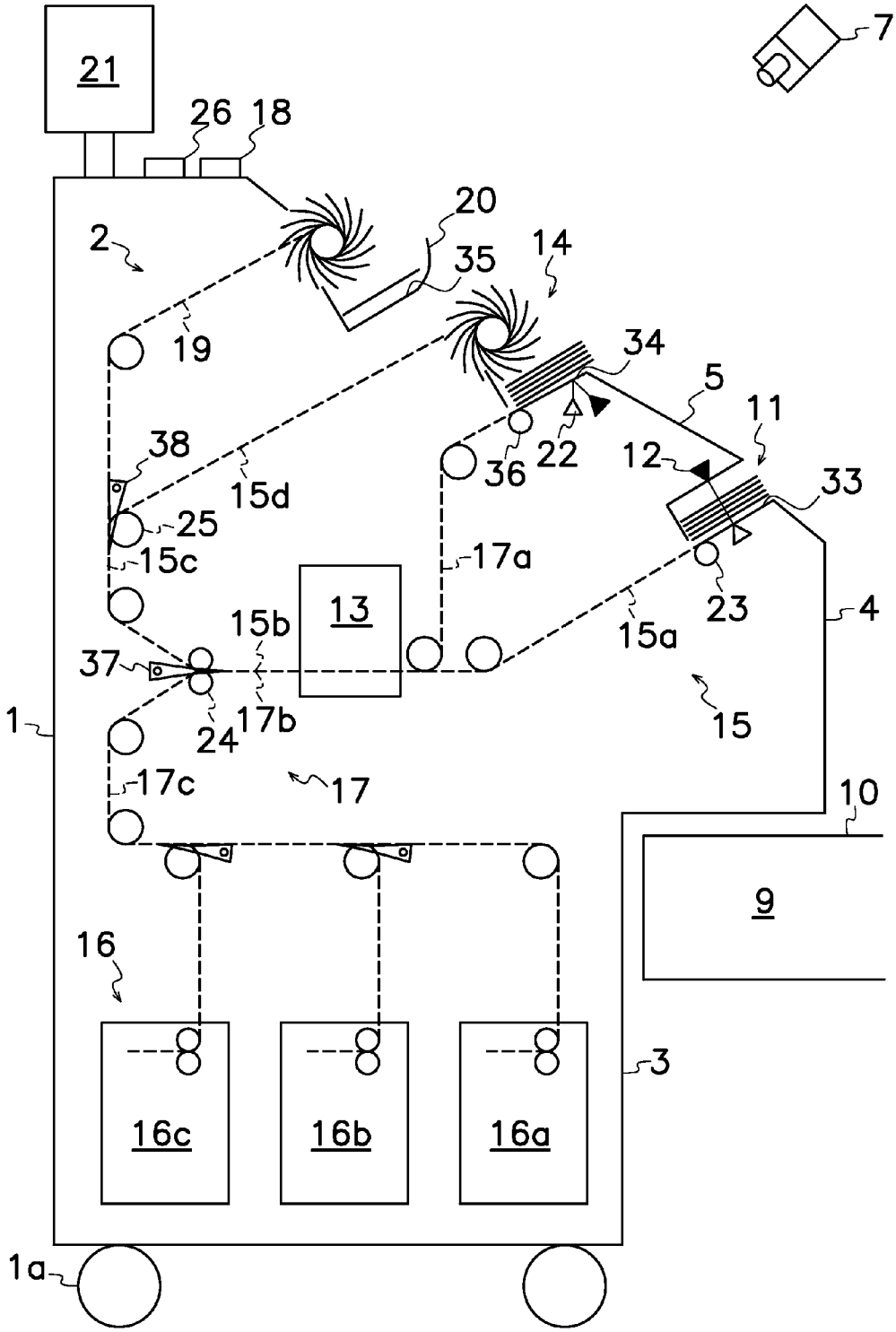
FIG. 1 is a schematically sectional view of a first embodiment of the bill handling apparatus according to the present invention.
Figure 2:
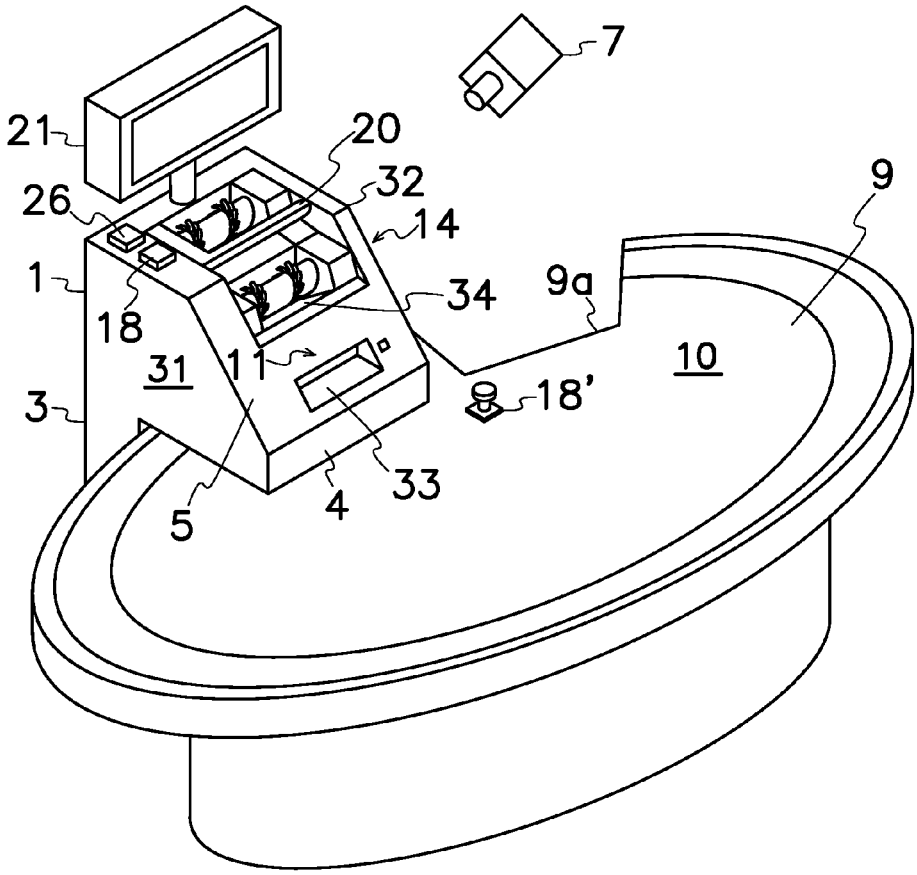
FIG. 2 is a perspective view of the bill handling apparatus arranged adjacent to a gaming table.

FIGS. 1 and 2 illustrate a first embodiment of the present invention applied to a bill handler or bill validation apparatus that comprises a casing 1 having a lower casing 3 disposed adjacent to a gaming table 9 and an upper casing 4 provided on lower casing 3. Upper casing 4 comprises a pair of side walls 31, 32, a front wall 5 connected to side walls 31, 32 and a deposit chamber 11 formed on an external side of upper casing 4 on the same level as or above a playing surface 10 of gaming table 9 so that a dealer may put in deposit chamber 11 bills collected from playing surface 10. Also, formed on the external side of upper casing 4 is an escrow chamber 14 that may receive genuine bills sent from deposit chamber 11 through a validator 13. Also, formed on the external side of upper casing 4 is a reject chamber 20 that may receive bill or bills that validator 13 has evaluated as inauthentic.

Deposit chamber 11 comprises an inwardly downward slant support plate 33 secured between side walls 31, 32 to support bills in deposit chamber 11. Also, escrow chamber 14 comprises an inwardly downward slant support plate 34 secured between side walls 31, 32 to support bills in escrow chamber 14. Reject chamber 20 comprises an inwardly downward slant support plate 35 secured between side walls 31, 32 to support bills in reject chamber 20.

The apparatus comprises an escrow carrier 15 for transporting bills from deposit chamber 11 to escrow chamber 14, a stacker 16 arranged in lower casing 3 for stowing bills sent from escrow chamber 14, a stack carrier 17 for transporting bills from escrow chamber 14 to stacker 16 for storage of bills in stacker 16, a validator 13 located in upper casing 4 for evaluating or validating authenticity of bills conveyed from deposit chamber 11 so that escrow carrier 15 transports only genuine bills to escrow chamber 14, a drive device 2 (FIG. 4) for driving escrow carrier 15 and stack carrier 17, a trigger switch 26 for producing a trigger signal to drive device 2 that thereby produces drive signals to escrow carrier 15, a monitoring camera 7 disposed above and in front of front wall 5 of upper casing 4 for shooting the condition of bills put in deposit chamber 11 and transported to escrow chamber 14, an image display 27 for indicating or recording in real time visual images captured by monitoring camera 7, and a money display 21 for exhibiting each money amount and denomination of bills that validator 13 has evaluated as genuine.

Validator 13 sends examined bill information to a control device 30 of drive device 2 that transfers the information to money display 21 to exhibit the information on its operational guide screen. Money display 21 may have a mobile operational touch panel or a tablet terminal input device electrically linked to control device 30 of drive device 2 through wireless or wired connection to produce some trigger signals from drive device 2 to drive escrow carrier 15 or stack carrier 17.

Figure 3:
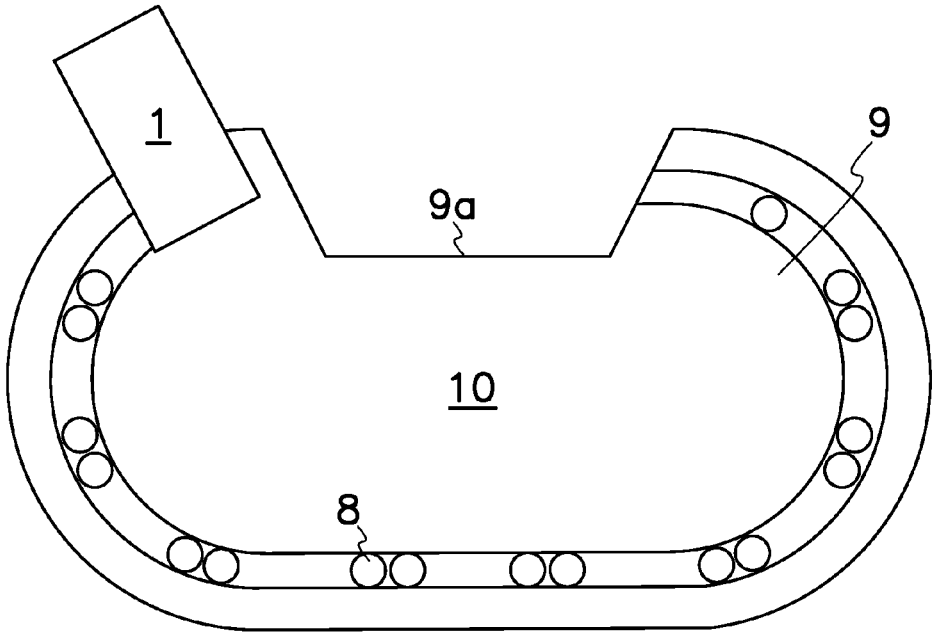
FIG. 3 is a plan view of FIG. 2.

As seen in FIG. 3, gaming table 9 has a generally oval gaming surface 10 formed with a depressed dealer station 9*a*, beside which casing 1 is arranged but it may have wheels 1*a* at the bottom to smoothly move it toward or away from gaming table 9. As shown in FIG. 1, deposit, escrow and reject chambers 11, 14 and 20 are formed on upper casing 4 in a line, along an arcuate line or in the stepped configuration. Escrow carrier 15 is arranged to transport genuine bills from deposit chamber 11 to escrow chamber 14 through validator 13, and escrow carrier 15 serves to transport bills considered inauthentic from deposit chamber 11 to reject chamber 20 through validator 13. Stack carrier 17 is arranged to transport bills from escrow chamber 14 to stacker 16. A dealer at dealer station 9*a* may have a direct access to each of deposit, escrow and reject chambers 11, 14 and 20 all formed on front wall 5 or top wall of upper casing 4, and he can put bills in deposit chamber 11, and can hold with his hand and pick up bills from escrow and reject chambers 14 and 20.

Deposit chamber 11 has a deposit sensor 12 for detecting insertion of bills into deposit chamber 11 to produce a detection signal when a dealer collects bills from players and inserts them into deposit chamber 11. Control device 30 of drive device 2 may store data on denominations and number of the bills evaluated by validator 13, and may transmit the data on bills to a data archiving system (not shown) for their storage therein. Control device 30 may also transmit the data stored in the data archiving system to a supervising host computer (not shown) through a communication device (not shown).

Escrow chamber 14 has a non-contact sensor 22 electrically connected to drive device 2 for detecting existence of bills in escrow chamber 14 to produce a detection signal. Stack carrier 17 has a stack switch 18 or 18' attached to upper casing 4 for producing a trigger signal to drive stack carrier 17 that is driven by operation of stack switch 18 or 18' when non-contact sensor 22 produces the detection signal. Escrow carrier 15 is driven by drive signals from control device 30 to transport bills from deposit chamber 11 through validator 13 to escrow chamber 14 when trigger switch 26 produces the trigger signal. Bills are put in deposit chamber 11 sidewise or in their transverse configuration to the conveyed direction of bills, and bills are transported by escrow carrier 15 to escrow chamber 14 after turning over bills by any turnover device on the way of the transportation, and fed in escrow chamber 14 in their transverse configuration to the transported direction.

As understood from FIG. 1, escrow carrier 15 comprises deposit discharge rollers 23 disposed adjacent to support plate 33 but being in contact to a bottom surface of a lowermost bill in deposit chamber 11 to discharge bills from deposit chamber 11 upon rotation of deposit discharge rollers 23, a first escrow carrier 15*a* for transporting bills discharged from deposit chamber 11 to validator 13, a second escrow carrier 15*b* for transporting bills passed through validator 13 to a first fork 24 with a first deflector 37, a third escrow carrier 15*c* for transporting bills from first fork 24 to a second fork 25 with a second deflector 38, and a fourth escrow carrier 15*d* for transporting bills from second fork 25 to escrow chamber 14 with a stacking impeller.

First deflector 37 at first fork 24 may be switched or shifted to either one of passages toward escrow chamber 14 by third and fourth escrow carriers 15*c* and 15*d*, toward reject chamber 20 by a reject carrier 19 or toward stacker 16 by a third stack carrier 17*b*. Fourth escrow carrier 15*d* and reject carrier 19 have similar stacking impellers to uniformly supply bills in escrow and reject chambers 14 and 20, and such stacking impellers are shown for example in Japanese Patent Publication No. 63-12316 published Mar. 18, 1988. A second deflector 38 is provided at second fork 25 of third escrow carrier 15*c* to select either one of passages to escrow chamber 14 by fourth escrow carrier 15*d* or to reject chamber 20 by reject carrier 19. When second deflector 38 may be shifted to convey bills toward escrow chamber 14 by third and fourth escrow carriers 15*c* and 15*d* or toward reject chamber 20 by reject carrier 19.

Stack carrier 17 comprises escrow discharge rollers 36 disposed adjacent to support plate 34 but being in contact to a bottom surface of a lowermost bill in escrow chamber 14 for discharging bills from escrow chamber 14 upon rotation of escrow discharge rollers 36, a first stack carrier 17*a* for transporting bills discharged by escrow discharge rollers 36 from escrow chamber 14 to validator 13, a second stack carrier 17*b* for transporting bills passed through validator 13 to first fork 24, and a third stack carrier 17*c* for transporting bills from first fork 24 to stacker 16. Stacker 16 has first, second and third stackers 16*a*, 16*b* and 16*c* for separately accumulating bills of different denominations or documents of different kinds. In lieu of or without second stack carrier 17*b*, second escrow carrier 15*b* may be driven in the adverse direction.

Figure 4:
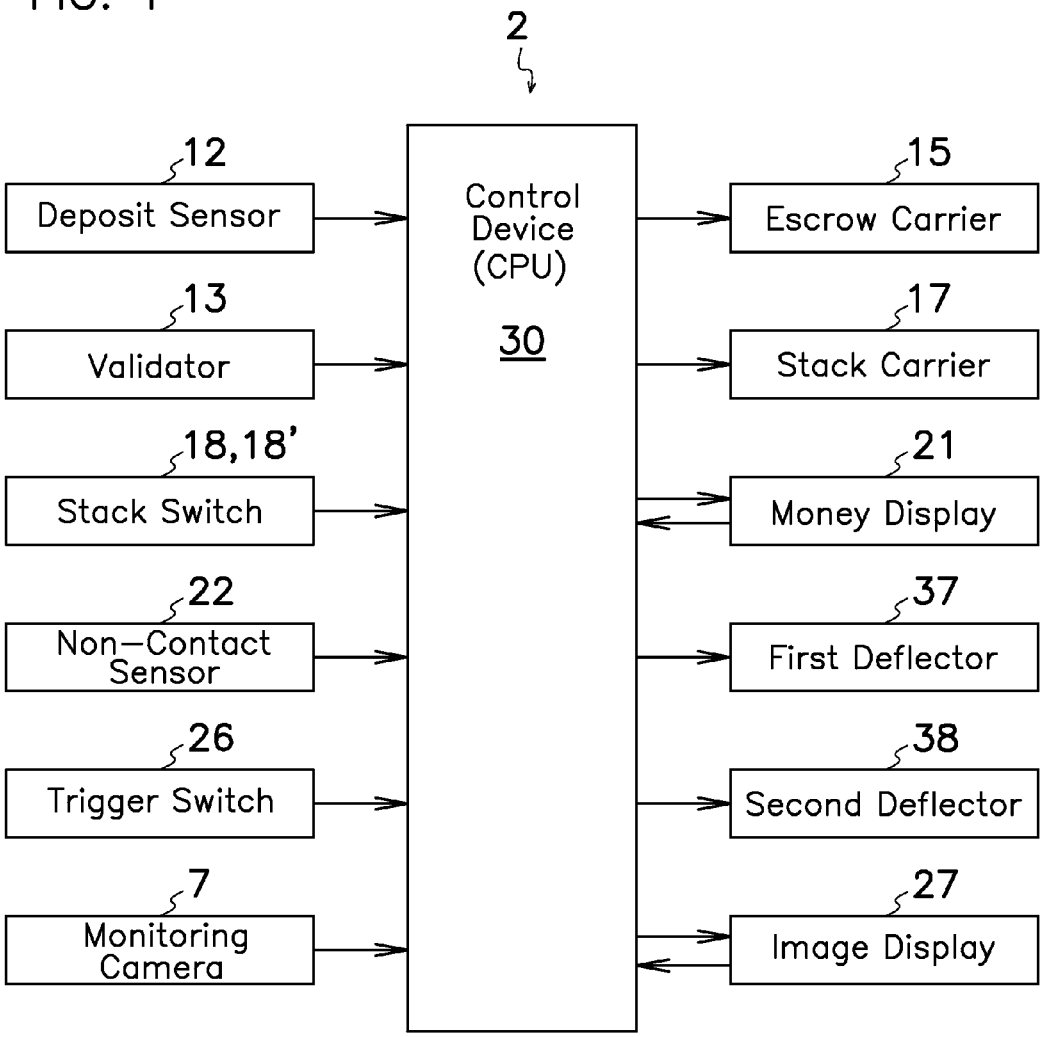
FIG. 4 is an electric circuit diagram of a drive device used in the bill handling apparatus.

As shown in FIG. 4, drive device 2 of the apparatus comprises a control device 30 of a single or a plurality of central processing units having input terminals each connected to deposit sensor 12, validator 13, stack switch 18 or 18', non-contact sensor 22, trigger switch 26 and monitoring camera 7. Output terminals of control device 30 each are connected to escrow carrier 15, stack carrier 17, money display 21, first deflector 37, second deflector 38 and image display 27. First and second deflectors 37 and 38 may comprise actuators such as solenoids drivingly connected to control device 30 to orient the direction for transporting bills by first and second deflectors 37, 38 driven by output signals of control device 30.

Figure 6:
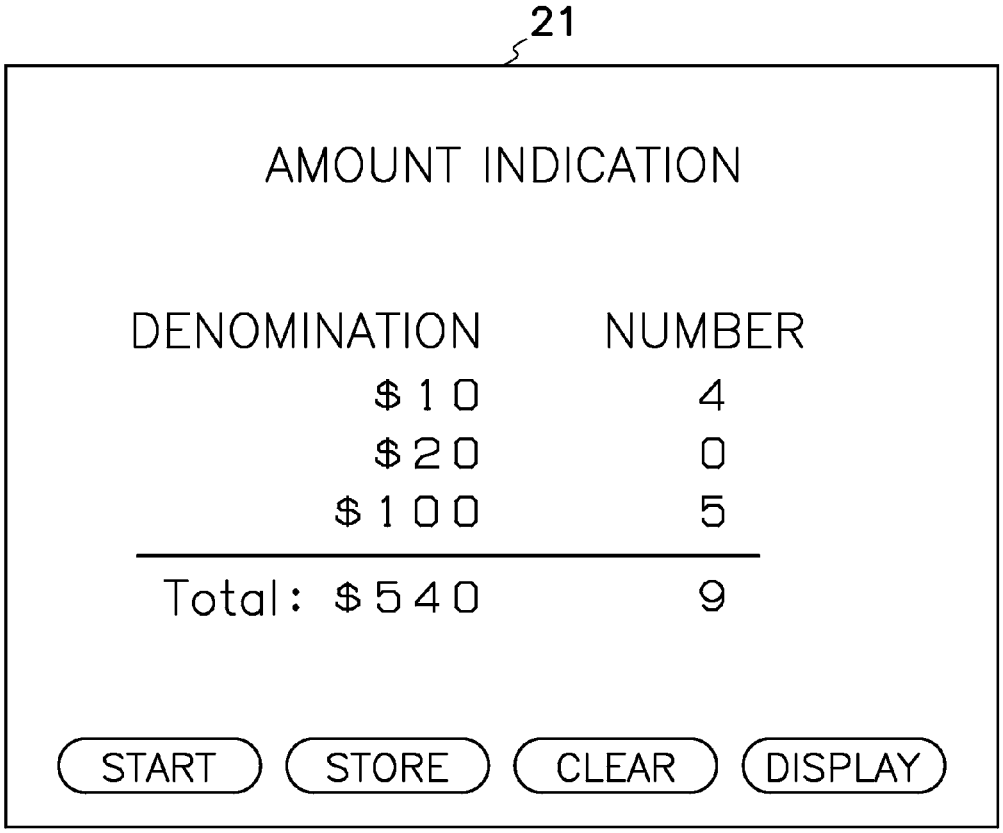
FIG. 6 is a front view of a money display with an operational guide screen.

FIG. 6 exemplifies an operational guide screen of money display 21 that comprises a touch panel showing trigger keys "START", "STORE", "CLEAR" and "DISPLAY". Each trigger key on the screen is linked to control device 30 through electronically wireless or electrically wired connection. When a dealer touches trigger key "START" on money display 21 with his finger, control device 30 is operated to drive escrow carrier 15 that thereby transports bills considered genuine from deposit chamber 11 though validator 13 to escrow chamber 14, and transports bills considered counterfeit by validator 13 to reject chamber 20. Validator 13 counts money amount of bills sent to escrow chamber 14 updating previous data and transmits money amount data to money display 21 for indication of money amount data on money display 21. Accordingly, trigger key "START" serves as an escrow switch.

When a dealer touches trigger key "STORE" on money display 21, control device 30 drives stack carrier 17 that transports bills in escrow chamber 14 to stacker 16 and stows bills in stacker 16, and accordingly, trigger key "STORE" serves as a stack switch. Control device 30 receives bill information from validator 13 and transfers the bill information to money display 21 that thereby indicates a total money amount of bills stowed in stacker 16. When a dealer touches trigger key "CLEAR" on money display 21, control device 30 forwards electric signals to erase money amount of bills indicated on money display 21. When trigger key "DISPLAY" is touched, money display 21 indicates money amounts per denomination of bills stowed in stacker 16. Shown money display 21 is electrically communicated with control device 30 through wired connection to transmit and receive electric signals between money display 21 and control device 30.

Players are seated around an oval gaming table 9 in the vicinity of their respective drink cups 8, and all players can see or observe deposit chamber 11 on front wall 5 and bills accumulated in deposit chamber 11. Players put bills required for gaming on playing surface 10 of gaming table 9, and a dealer collects bills on playing surface 10 and puts them together or in a lump into deposit chamber 11. However, unlike the shown arrangement, front wall 5 and deposit chamber 11 may be arranged on the same or another level as playing surface 10 of gaming table 9. In this case, upper casing 4 may be arranged adjacent to gaming table 9 and a part of upper casing 4 may overhang gaming table 9.

As more fully described below, drive device 2 works in accordance with an operational sequence shown in a flow chart of FIG. 5. A dealer collects bills on playing surface 10 of game table 9 as shown in FIGS. 2 and 3 and puts collected bills in deposit chamber 11 of upper casing 4 in their transverse configuration. Processing moves on from Step 50 to 51 where deposit sensor 12 detects bills in deposit chamber 11 to produce a detection signal to control device 30. In this situation, a dealer touches trigger key "START" on guide screen of money display 21 with his finger or operates or turns on trigger switch 26 (Step 52) and control device 30 provides drive signals for escrow carrier 15. So, escrow carrier 15 is driven (Step 53) to rotate deposit discharge rollers 23 so that bills are discharged from deposit chamber 11 and forwarded to validator 13 by first escrow carrier 15.

In this case, when deposit sensor 12 detects bills in deposit chamber 11, control device 30 may automatically drive escrow carrier 15 to feed bills to validator 13 without operation of trigger key "START" or trigger switch 26. In Step 54, validator 13 determines whether bills are legitimate or counterfeit, and bills considered genuine are sent by second escrow carrier 15*b* through first fork 24, first deflector 37, third escrow carrier 15*c*, second fork 25, second deflector 38 and fourth escrow carrier 15*d* to escrow chamber 14 (Step 55) to accumulate and temporarily and removably retain bills on support plate 34 of escrow chamber 14 in their transverse configuration after turning over bills on the conveyed way (Step 56). Turning over of bills allows all players and dealer to clearly observe or see both front and back surfaces of each bill in deposit and escrow chambers 11 and 14 to visually confirm authenticity of collected bills, and the dealer may freely pick up bills from escrow chamber 14.

Also, all players may visually from outside observe or watch the accumulated condition, stacked condition of bills in escrow chamber 14 and the discharged condition of bills from escrow chamber 14 to stacker 6. Then, in Step 58, control device 30 determines on whether to receive the detection signal from deposit sensor 12, and again repeats operations in Steps 53 to 58 if at least one of bills remains in deposit chamber 11. Without any bill in deposit chamber 11, deposit sensor 12 stops the detection signal and control device 30 ceases operation of escrow carrier 15 (Step 59).

Non-contact sensor 22 may detect existence of bills in escrow chamber 14 to produce a detection signal, and when a dealer operates stack switch 18 or 18' on upper casing 4 or on playing surface 10 or touches trigger key "STORE" on money display 21 with his finger (Step 61) while non-contact sensor 22 detects bills (Step 60), control device 30 drives stack carrier 17 and so bills are discharged from escrow chamber 14 by escrow discharge rollers 36 and transported again to validator 13 (Step 63). Bills considered as genuine by validator 13 are sent to stacker 16 through first fork 24 and first deflector 37 by second and third stack carriers 17*b* and 17*c* (Step 64).

In this case, control device 30 drives necessary deflectors to transport and separately stack bills of different denominations in first, second and third stackers 16*a*, 16*b* and 16*c*. Bills considered as inauthentic by validator 13 are sent to reject chamber 20 through first fork 24, first deflector 37, second fork 25 and second deflector 38 by second stack carrier 17*b*, third escrow carrier 15*c* and reject carrier 19 (Step 65). In Step 66, control device 30 determines on whether to receive the detection signal from non-contact sensor 22, and again repeats operations in Steps 62 to 66 if at least one of bills remains in escrow chamber 14. Without any bill in escrow chamber 14, non-contact sensor 22 stops emission of detection signal to control device 30 that ceases operations of stack carrier 17 (Step 67) and drive device 2 (Step 68).

When validator 13 considers bills to be inauthentic in Step 54, control device 30 receives an inauthentic signal from validator 13 and drives second stack carrier 17*b*, first deflector 37, third escrow carrier 15*c*, second deflector 38 and reject carrier 19 to transport counterfeit bill to reject chamber 20 through first fork 24, first deflector 37, second fork 25, second deflector 38 (Step 57 to 58).

Figure 7:
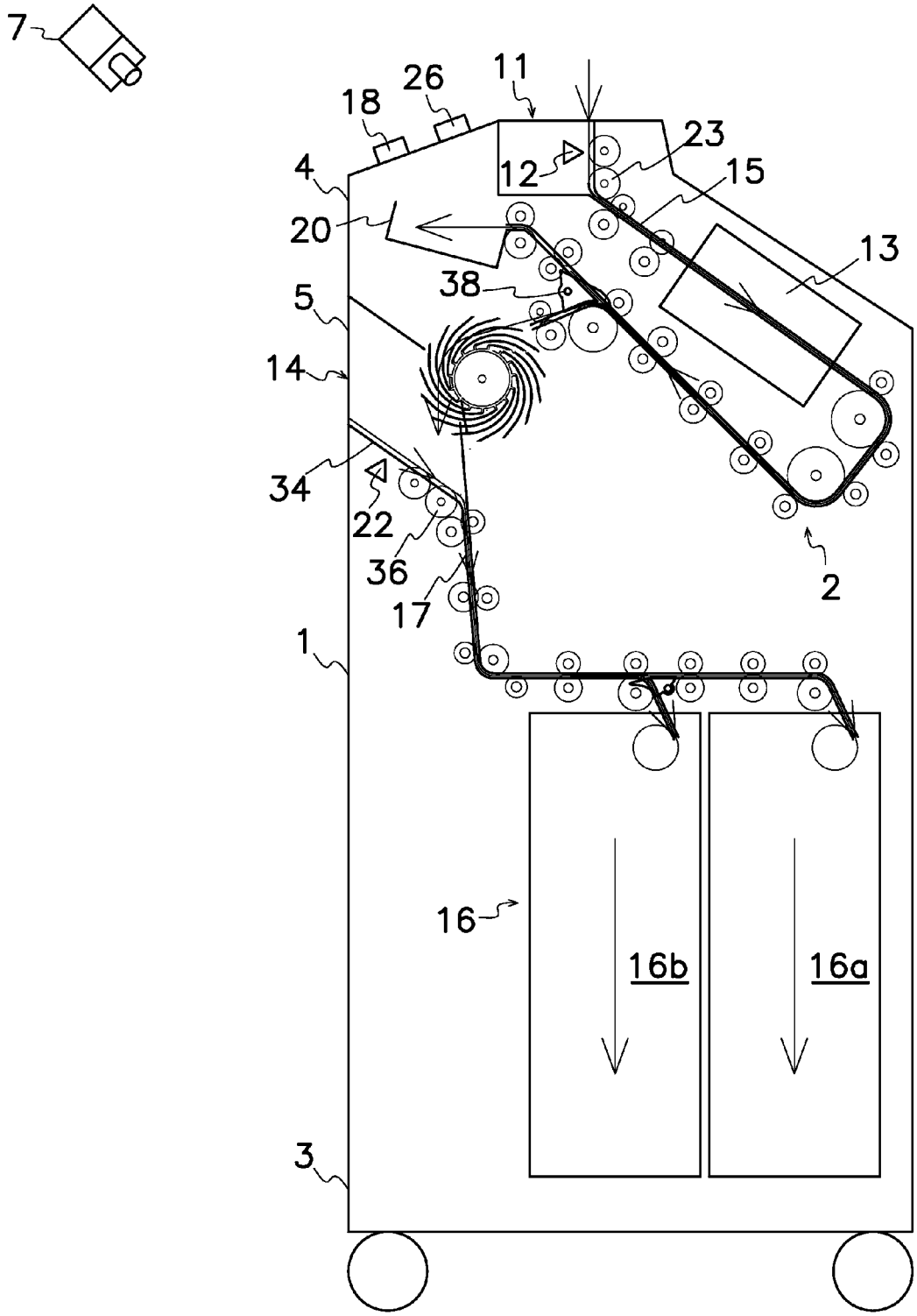
FIG. 7 is a schematically sectional view of a second embodiment of the bill handling apparatus according to the present invention.

As shown in FIGS. 1 and 7, a monitoring camera 7 is disposed above and in front of a front wall 5 of casing 1 to shoot the condition of bills put in deposit chamber 11 and transported to escrow chamber 14, and an image display 27 (FIG. 4) may indicate or record in real time visual images captured by monitoring camera 7. This can further improve security of bills' authenticity, transparency and fairness in collection of bills.

The above-mentioned embodiment may convey only genuine bills from deposit chamber 11 to escrow chamber 14 by means of escrow carrier 15 while all players and dealer can freely watch and remove from outside bills temporarily retained in escrow chamber 14 with the naked eye to accurately identify nonparticipation of unjustifiable acts on bills in escrow chamber 14, and then, bills are further conveyed from escrow chamber 11 to stacker 16 by activating stack carrier 17 upon operation of stack switch 18 or 18'. In this way, genuine bills fed in and discharged from escrow chamber 14 can be seen or picked up from outside of casing 1 because escrow chamber 14 is completely opened or exposed to the outside.

In this way, people around the bill handling apparatus can directly observe bills that a dealer puts in deposit chamber 11, that validator 13 examines as genuine and that escrow chamber 14 receives from validator 13 to confirm no fraud on the gaming. Even if any problem or question arises on bills in escrow chamber 14, bills may be taken out from escrow chamber 14 for confirmation of bill or bills in question. Then, stack switch 18 or 18' is operated to trigger stack carrier 17 to transport bills from escrow chamber 14 to stacker 6. Consequently, the apparatus may make further improvement in security of bill authenticity, transparency and fairness in collection of bills and so the dealer can smoothly conduct games.

The foregoing embodiment according to the present invention may be modified, changed and altered in various ways. By way of example, ordinary skill in the art may change or determine, as necessary, the arranged positions and order of deposit, escrow and reject chambers 11, 14 and 20 on front wall 5 of upper casing 4 or may add further chambers unlike the embodiment. In lieu of stacking impellers in escrow or reject chamber 14, 20, stack carrier 15 or reject carrier 19 may transport bills directly to escrow or reject chamber 14, 20 through other stacking device or without any stacking device.

FIG. 7 illustrates a second embodiment of the bill handling apparatus according to the present invention. Drive device 2 used in bill handling apparatus shown in FIG. 7 is operated in a similar fashion in accordance with operational sequence of flow chart shown in FIG. 5 but without Steps 63 and 65, in other words, in order of Steps 62, 64 and 66 because bill handling apparatus of FIG. 7 lacks in a conveyance system to again pass bills through validator 13 twice between escrow chamber 14 and stacker 16.

A dealer collects bills on playing surface 10 of game table 9 and puts sidewise collected bills in deposit chamber 11. Processing moves on from Step 50 to 51 where deposit sensor 12 detects bills in deposit chamber 11 to produce a detection signal to control device 30. Then, a dealer touches trigger key "START" on operational guide screen of money display 21 with his finger to turn on trigger switch 26 (Step 52) and to allow control device 30 to provide drive signals for escrow carrier 15. So, escrow carrier 15 is driven (Step 53) to rotate deposit discharge rollers 23 so that bills are discharged from deposit chamber 11 and forwarded to validator 13 by first escrow carrier 15.

In this case, when deposit sensor 12 detects bills in deposit chamber 11, control device 30 may automatically drive escrow carrier 15 to feed bills to validator 13 without operation of trigger key "START" or trigger switch 26. In Step 54, validator 13 determines whether bills are legitimate or counterfeit, and here, bills considered genuine are sent by escrow carrier 15 through second deflector 38 to escrow chamber 14 (Step 55) to accumulate sidewise and temporarily retain bills in escrow chamber 14 (Step 56) after turning over bills on the conveyed way. Also, all players may visually observe the accumulated condition, stacked condition of bills in escrow chamber 14 and the discharged condition of bills from escrow chamber 14 to stacker 6.

In Step 54, bills considered counterfeit by validator 13 are sent to reject chamber 20 through second deflector 38 by escrow carrier 15 (Step 57). Then, in Step 58, control device 30 determines on whether to receive the detection signal from deposit sensor 12, and again repeats operations in Steps 53 to 58 if at least one of bills remains in deposit chamber 11. Without any bill in deposit chamber 11, deposit sensor 12 stops the detection signal and control device 30 ceases operation of escrow carrier 15 (Step 59).

Non-contact sensor 22 may detect existence of bills in escrow chamber 14 to produce a detection signal (Step 60), and when a dealer operates stack switch 18 or 18' on upper casing 4 or on playing surface 10 or touches trigger key "STORE" on money display 21 with his finger (Step 61) while non-contact sensor 22 detects bills, control device 30 drives stack carrier 17 and so bills are discharged from escrow chamber 14 by escrow discharge rollers 36 and forwarded to stacker 16 by stack carrier 17 (Step 64). In this case, control device 30 drives necessary deflectors to transport and separately stack bills of different denominations in first and second stackers 16*a* and 16*b*. In Step 66, control device 30 determines on whether to receive the detection signal from non-contact sensor 22, and again repeats the operations in Steps 62 to 66 if at least one of bills remains in escrow chamber 14. Without any bill in escrow chamber 14, non-contact sensor 22 stops emission of detection signal to control device 30 that ceases operations of stack carrier 17 (Step 67) and drive device 2 (Step 68).

Figure 8:
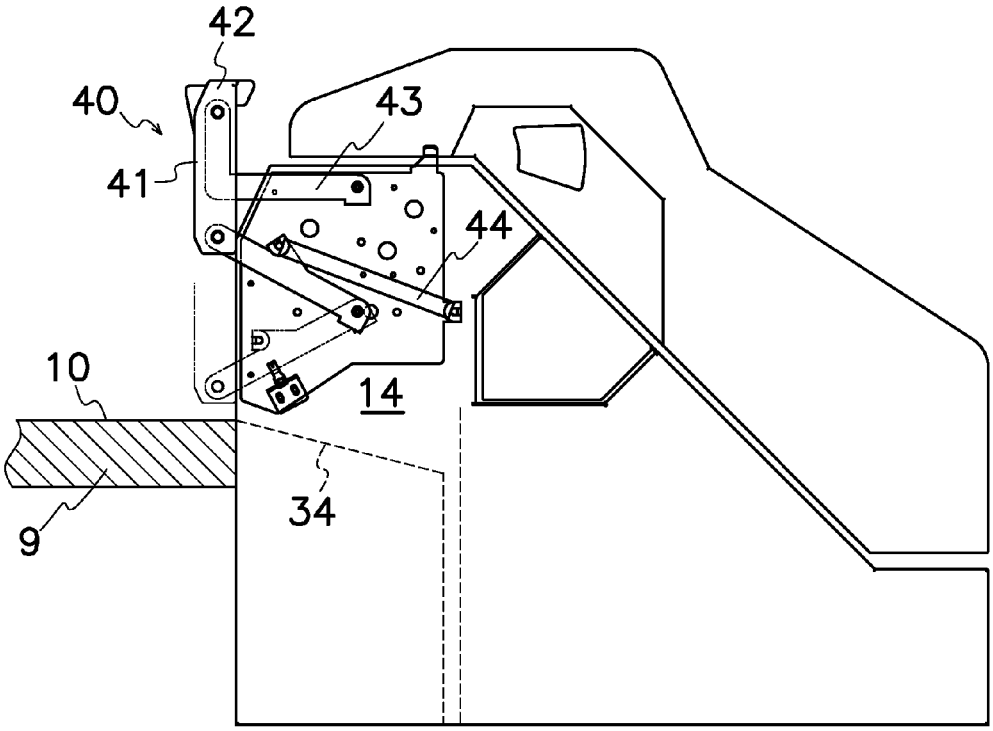
FIG. 8 is a sectional view of a transparent covering in the opened position of a lid away from the front of the escrow chamber.
Figure 9:
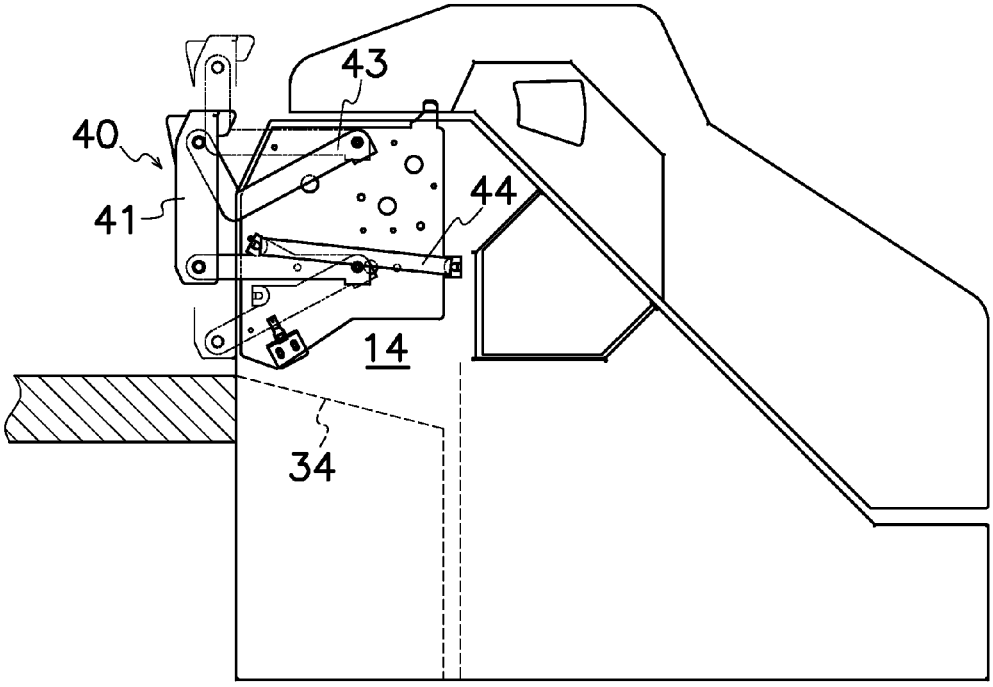
FIG. 9 is a sectional view of the covering at an intermediate position of the lid on the way moved between the opened and closed positions.
Figure 10:
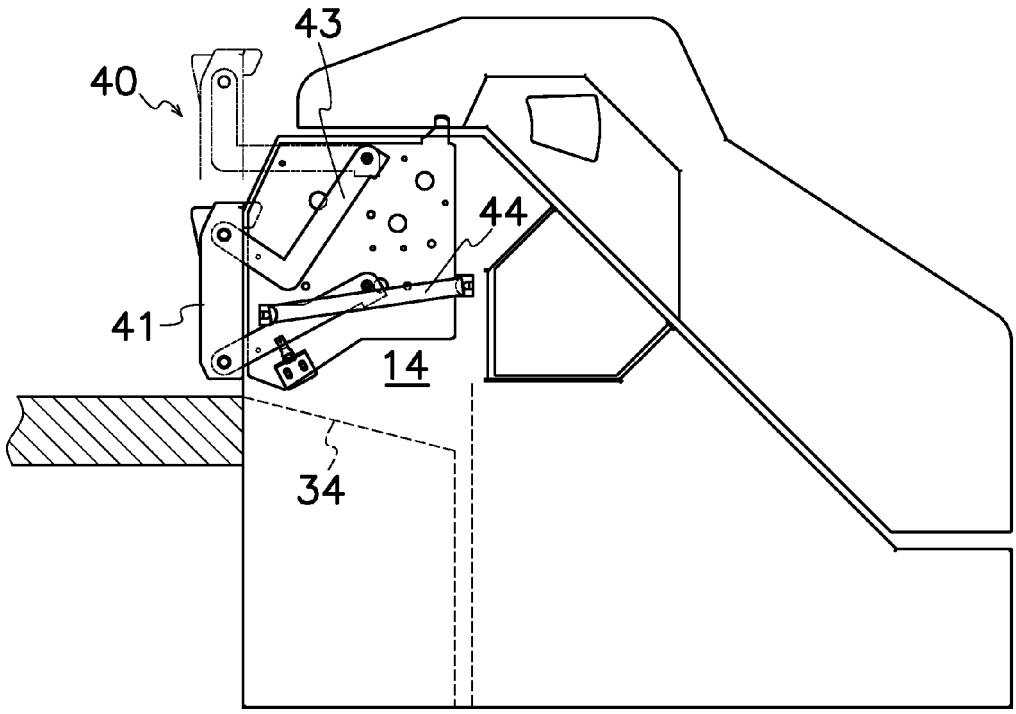
FIG. 10 is a sectional view of the covering in the closed position of the lid blocking the front of the escrow chamber.

FIGS. 8 to 10 exhibit a covering 40 attached to upper casing 4. Covering 40 comprises a lid 41 made of a transparent material, movable toward and away from the front of escrow chamber 14 between the closed and opened positions for respectively blocking and opening the front of escrow chamber 14, a handle 51 provided at a top of lid 41, a link mechanism 43 attached between lid 41 and upper casing 4 to manually move lid 41 toward and away from the front of escrow chamber 14, and a retention spring 44 connected between link mechanism 43 and upper casing 4. FIG. 8 shows covering 40 in the opened position of lid 41 away from the front of escrow chamber 14 to open it. In addition, another actuator may be used to lock and unlock a locking device (not shown) that serves to firmly secure lid 41 to upper casing 2 to avoid inadvertent removal of bills from escrow chamber 14. The locking device may be unlocked to move lid 41 between the opened and closed positions.

A dealer may hold handle 51 with his hand and manually move lid 41 downward to the closed position to block the front of escrow chamber 14. FIG. 9 indicates lid 41 at an intermediate position on the way between the opened and closed positions, and retention spring 44 comes to its maximum extension at the intermediate position of lid 41. When moved to the opened position of FIG. 8 or to the closed position of FIG. 10, lid 41 is retained in the opened or closed position by tensile resilient force of retention spring 44 that provides snap actions in a bistable toggle mechanism set up by combined link mechanism 43 and retention spring 44 to stabilize lid 41 at its opened or closed position by elastically pulling link mechanism 43 from the intermediate position by retention spring 44. As maximum tensile force by retention spring 44 is not in excess of manual force by dealer, he can manually move lid 41 between the closed and opened positions at will. Instead, lid 41 may be automatically moved between the closed and opened positions by means of an actuator such as a motor or solenoid.

INDUSTRIAL APPLICABILITY

This invention is applicable to document handlers for table games for validating documents, for visibly to players and removably from outside and temporarily accumulating the documents in an escrow chamber and for finally stowing the documents in a stacker.

What is claimed are:

1. A document handler for table games comprising:

a casing arranged adjacent to a gaming table, a deposit chamber formed on an external side of the casing for receiving documents, an escrow chamber formed on the external side of the casing for temporarily receiving documents considered genuine sent from the deposit chamber so that the documents sent into the escrow chamber are visible and observable to players who are seated around the gaming table, the documents in the escrow chamber being removable from outside of the casing, an escrow carrier for continuously transporting the documents in the deposit chamber to the escrow chamber, a drive device for driving the escrow carrier, a stacker for stowing the documents sent from the escrow chamber, a stack carrier for transporting the documents from the escrow chamber to the stacker for storage of the documents in the stacker, a non-contact sensor for detecting the documents in the escrow chamber to produce a detection signal, and a stack switch attached to the casing for producing a trigger signal to drive the stack carrier, wherein the non-contact sensor and stack switch are electrically connected to the drive device, and the stack carrier is triggered by operation of the stack switch when the non-contact sensor produces the detection signal.

2. The document handler of claim 1, wherein at least one part of the escrow chamber is exposed or opened to outside of the casing or is closed by a transparent covering to render the documents in the escrow chamber visible to players seated near the casing.

3. The document handler of claim 1, further comprising:

a trigger switch for producing a trigger signal to the drive device that thereby produces drive signals to the escrow carrier, and a validator located in the casing for validating the authenticity of the document conveyed from the deposit chamber to the escrow chamber, wherein the escrow carrier is driven by the drive signals from the drive device to transport the documents from the deposit chamber through the validator to the escrow chamber when the trigger switch produces the trigger signal.

4. The document handler of claim 1, wherein the drive device drives the stack carrier.

5. The document handler of claim 1, wherein the casing may be moved toward and away from the gaming table.

6. The document handler of claim 1, further comprising a money display for exhibiting denominations and number or total money amount of the documents that the validator has evaluated as genuine.

7. The document handler of claim 6, wherein the money display has an operational touch panel electrically connected to the drive device for producing a trigger signal to drive the escrow carrier or stack carrier.

8. The document handler of claim 1, further comprising a covering that has a lid attached to the casing for movement of the lid between the closed and opened positions for respectively blocking and opening the front of the escrow chamber.

9. A document handler for table games comprising:

a casing having a lower casing disposed adjacent to a gaming table and an upper casing located on the lower casing, a deposit chamber formed on an external side of the upper casing on the same level as or above a playing surface of the gaming table to receive documents in the deposit chamber, an escrow chamber formed on an external side of the upper casing to temporarily receive documents considered genuine sent from the deposit chamber so that the documents in the escrow chamber are visible and observable to players who are seated around the gaming table, the documents in the escrow chamber being removable from outside of the casing, an escrow carrier for transporting the documents in the deposit chamber to the escrow chamber, a drive device for driving the escrow carrier, a stacker for stowing the documents sent from the escrow chamber, a stack carrier for transporting the documents from the escrow chamber to the stacker for storage of the documents in the stacker, a non-contact sensor for detecting the documents in the escrow chamber to produce a detection signal, and a stack switch attached to the casing for producing a trigger signal to drive the stack carrier, wherein the non-contact sensor and stack switch are electrically connected to the drive device, and the stack carrier is triggered by operation of the stack switch when the non-contact sensor produces the detection signal.

10. The document handler of claim 9, wherein the drive device drives the stack carrier.

11. The document handler of claim 9, further comprising a covering that has a lid attached to the upper casing of the casing for movement of the lid between the closed and opened positions for respectively blocking and opening the front of the escrow chamber.

* * * * *